United States Patent [19]

Villavicencio

[11] 4,237,582

[45] Dec. 9, 1980

[54] BAGASSE PREPARATION

[75] Inventor: Eduardo J. Villavicencio, San Angel, Mexico

[73] Assignee: Process Evaluation & Development Corporation, Dallas, Tex.

[21] Appl. No.: 937,062

[22] Filed: Aug. 28, 1978

Related U.S. Application Data

[63] Continuation-in-part of Ser. No. 811,090, Jun. 29, 1977, abandoned.

[51] Int. Cl.[3] ..... D01B 1/30

[52] U.S. Cl. ..... 19/7; 19/27; 19/66 R

[58] Field of Search ..... 19/7, 26, 27, 8, 90, 19/66 R

[56] References Cited

U.S. PATENT DOCUMENTS

| | | | |
|---|---|---|---|
| 3,414,330 | 12/1968 | Trutzschler | 19/105X |
| 3,537,142 | 11/1970 | Villavicencio | 19/26 |
| 3,552,800 | 1/1971 | Truetzschler | 19/105 X |
| 3,688,345 | 9/1972 | Villavicencio | 19/7 |
| 3,877,110 | 4/1975 | McCloskey et al. | 19/66 R |

*Primary Examiner*—Louis Rimrodt

*Attorney, Agent, or Firm*—Michael J. McGreal

[57] ABSTRACT

The debris and pith removal from bagasse fiber is significantly enhanced by the flow of fiber from one depithing zone into a fiber washing zone and then to a second depithing zone without any intermediate settling of piling of the fiber. The fiber is maintained in a separated condition throughout the first depithing zone, the washer and the subsequent depithing zone. The result is a bagasse fiber having a greater quantity of the debris and pith removed with much less fiber damage.

5 Claims, 4 Drawing Figures

BAGASSE PREPARATION

This application is a continuation-in-part of U.S. application Ser. No. 811,090, filed June 29, 1977 now abandoned.

This invention relates to an improved system and method for processing fibrous vegetable materials so as to separate them into two portions, one of which is substantially fiber, i.e., pith free, and the other of which contains a major portion of the pith; both of which are substantially free of debris.

The depithing system and method of this invention separates fiber-containing stalk fragments into fiber and pith fractions, both of which are substantially free of debris. The separated fractions can then be used as desired. For example, the fiber portion can be used for pulp in the paper industry or as a basic raw material for making hardboard of various types. The pith fraction can be used as animal feed, chicken litter, animal bedding, or can be burned as fuel in industrial or heating boilers. The system and method of this invention is especially suitable for obtaining substantially pith-free fiber from sugarcane bagasse for paper-making purposes, but its use is not restricted to sugarcane bagasse alone. The system and method is also suitable for processing other material such as bamboo, corn stalks, straw, flax, rice hulls and similar vegetable matter.

The fibers of such materials are suitable for the production of pulp for use in paper or alpha-cellulose production, or other purposes, but their commercial use in such fields has been handicapped by the presence of varying amounts of pith and other non-fibrous material (debris) which is intimately admixed with the fibers, and which has a detrimental affect in such pulps. Its separation from the fibers by presently known methods is quite costly, and there is likely to be excessive fiber damage. That is, the techniques which very effectively remove pith excessively damage the fiber, while the techniques which provide a milder treatment usually do not remove a sufficient amount of pith so as to yield a fiber suitable for producing quality paper products or a dissolving pulp from which high strength rayon can be produced.

Bagasse is the name given to the cellular material which forms the remains of sugarcane after the sugar-containing juice has been extracted. In processing raw sugarcane, the cane stalks are first fed into a crushing roller and then into a series of roller-type mills which squeeze the cane and force the sugar-containing juice from the broken cells for further processing and refining treatment. After substantially all of the sugar-containing juice has been expelled from the cane, the remainder, which is then called bagasse, consists of relatively long fibers of substantially pure cellulose together with a large amount of pith, which consists of broken cells and other materials, as well as 2 to 3 percent by weight of retained sugar and rock, dirt and other debris. At this stage, the moisture content of the bagasse is relatively high, generally ranging between 48 and 52 percent by weight. Heretofore, it has been customary to use this bagasse as a fuel for heating and refining the expressed juices, but this is relatively inefficient because of the high percentage of retained moisture in the bagasse. It has been recognized that the long cellulosic fibers retained in bagasse have a high degree of potential utility for such purposes as paper pulp and the like, but the presence of the retained pith has prevented the economical utilization of the fiber because of detrimental effects of the retained pith on the finished paper product. If the bagasse is processed in too vigorous a manner, the fiber is broken or otherwise damaged during pith removal. Although the pith is successfully removed, such fiber is not that useful for a paper pulp due to its short length or structural damage which would yield low strength paper products.

The present system consists of a vertical depither, U-shaped washer, and a second vertical depither. These units are arranged one above the other so that after the bagasse or other vegetable fibers are metered into the first unit, they need not be metered throughout the rest of the system, but fall by gravity from unit to unit. However, each unit must be adjusted to handle the volume of fiber which it receives from the prior unit in the sequence. The preferred arrangement is to have a first depither disposed above the inlet of the U-shaped washer which in turn has a second depither disposed below the outlet end of the U-shaped washer. In this preferred arrangement, vegetable fiber fragments, such as bagasse fragments, are metered into the first (most elevated) depither by means of a pin feeder. The fragments are broken down by the hammers in the upper part of the first depither and substantially depithed through the remainder of the first depither. The depithed fiber falls directly from the first depither into the inlet to the U-shaped washer. The removed pith falls into a separate outlet and is conveyed to storage or use. The fiber is propelled through the washer which removes any water soluble matter such as residual sugar, any loosely clinging pith, and any dirt or rock from the harvesting of the sugar cane. The washed fiber is drained at the exit end of the washer and allowed to drop into the second (lower) depither in a moist condition. This fiber is then further depithed with the exiting fiber being conveyed to a digester for prehydrolysis and/or chemical pulping. The pith from the second depither is combines with that from the first deptier and conveyed to storage or use.

The advantages of this system are that only one rather than three metering pin feeders are required. Further, by systemizing the units the resulting fiber is cleaner since the intermediate washing removes various debris, loosely clinging pith and soluble materials such as sugar. Also, there is automatically provided a moist fiber for the second depithing operation. Moist depithing provides for greater pith removal after the first depithing which breaks up the larger fragments.

It is an important object of the present invention, therefore, to provide novel and improved methods of and means for treating and processing bagasse and other vegetable fibrous materials so as to obtain a maximum yield of high quality depithed fiber of optimum length and strength characteristics at a minimum cost. It is additionally an object to reduce the handling costs before, during and after fiber depithing.

The foregoing and other objects, characteristics and advantages of the present invention will be more clearly understood from the following description thereof when read in conjunction with the accompanying drawings in which.

The depithing devices which may be used in this invention are preferably of the vertical type as disclosed in U.S. Pat. Nos. 3,537,142 or 3,688,345. Although an in-line washer can be used it is preferred to use a U-shaped washer. Such a washer is described in U.S. Pat. No. 3,877,110. For purposes of this specification, the disclosures of U.S. Pat. Nos. 3,537,142, 3,688,345, and 3,877,110, are incorporated herein by reference.

Figure 1:
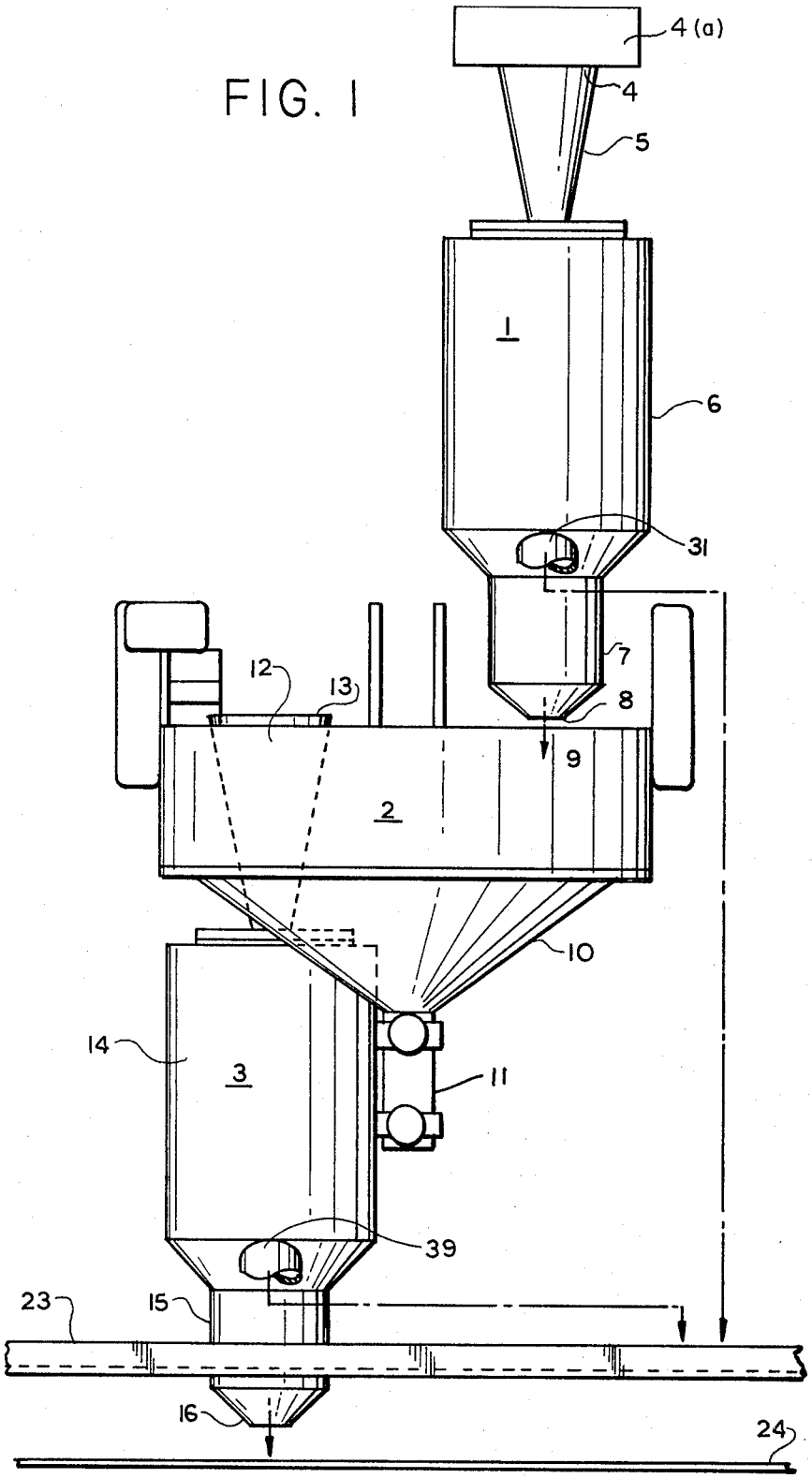
FIG. 1 is a front elevation of the system illustrating the general arrangement of the depither and washer units for processing bagasse in accordance with the present invention.

The present system will be more particularly described with relation to the Figures. In FIG. 1, the upper depither is designated by numeral 1 with the fiber washer designated 2 and lower depither designated 3. These are the three main units of equipment making up the present system. Vegetable fiber fragments such as bagasse are conveyed to the inlet 4 of upper depither 1 using any standard conveying device. Just prior to inlet 4 and subsequent to the conveyor is a pin feeder 4(*a*) which meters the fiber fragments into inlet 4 at a controlled rate. The fragments then fall through inlet chute 5 and into depithing chamber 6. In the depithing chamber, a substantial amount of the pith in the fiber fragments is separated from the fiber and removed through pith outlet 31 to pith collecting conveyor 23. The fiber fraction falls downwardly from the depithing chamber into fiber chute 7 to fiber outlet 8, where it falls by gravity into the inlet 9 of fiber washer 2. This fiber washer is preferably U-shaped with the inlet being at one leg of the U and the outlet being at the other leg of the U. The fibers are propelled through the washer by a series of rollers containing tines which repeatedly immerse the fibers as they propel them through the loop of the U 10 to the exit leg of the U. At the washer exit end 12 the fibers are drained and then fall by gravity into inlet 13 of lower depither 3. The moist fibers fall into depithing chamber 14 wherein further pith is removed which exits the depithing chamber at 39, and is collected on and removed via conveyor 23. The fiber fraction falls through fiber outlet chute 15 and through outlet 16, and onto fiber conveyor 24. This fiber would then usually be conveyed to a digester where it is converted into a cellulosic pulp.

Figure 2:
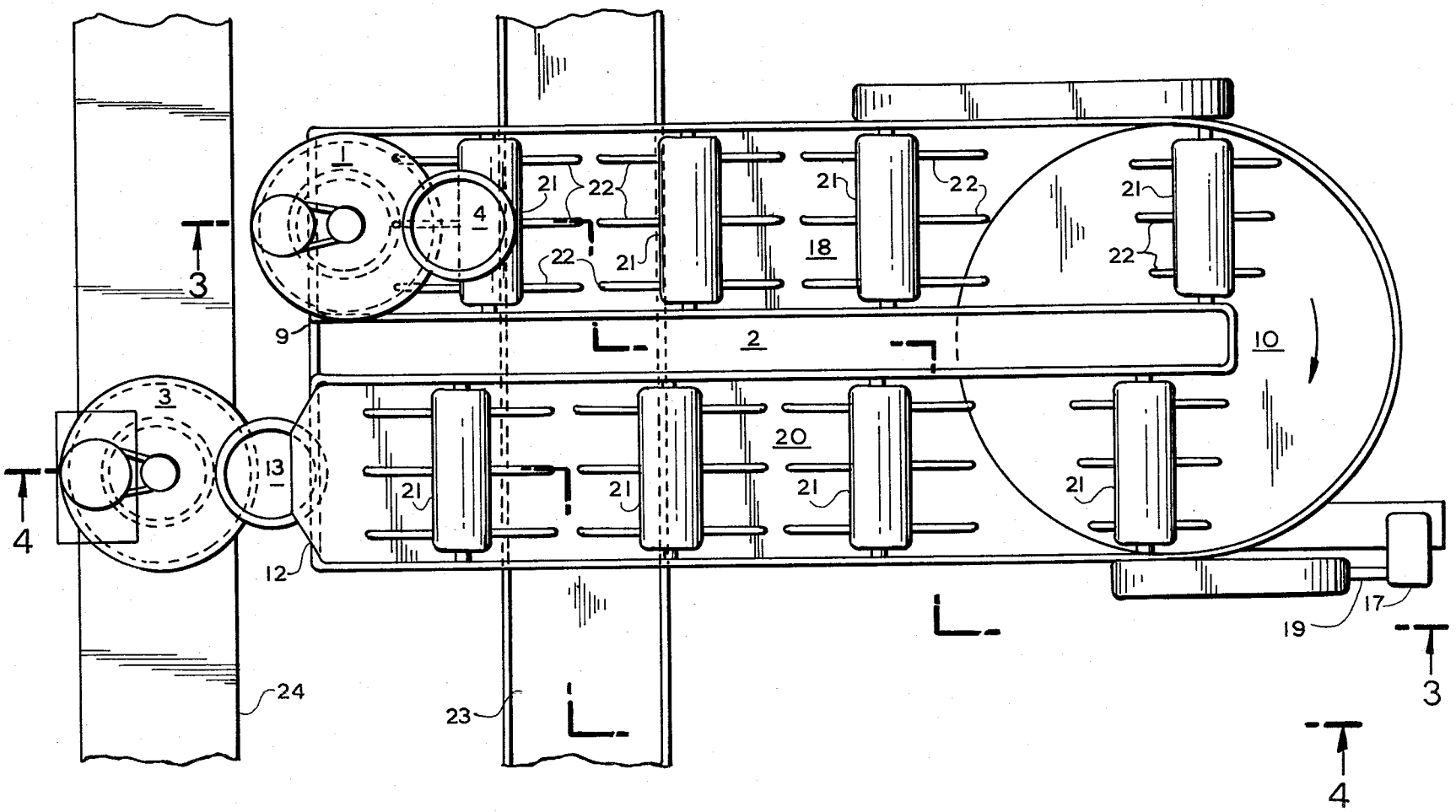
FIG. 2 is a top plan view of the fibrous material depithing system of the present invention showing the relationship of the depithing units and the intermediate washer unit.

The U-shaped washer 2 is particularly described in FIG. 2. Unit 1 is the upper depither and unit 3 the lower depither. The fiber from depither 1 enters the washer at unlet 9 and is conveyed through the washer by the tines 22 of roller 21. These rollers are driven by motor 17 through drive belts or chains 19. Sequentially, the fiber is propelled along the inlet leg 18 with immersing to the loop of the U 10 by the tines. At the loop of the U the tines are of varying length in order to more effectively move the fiber. This region 10 is substantially deeper than either leg of the washer and is the are where heavy debris settles and is removed by value assembly 11. From the region 10 the fiber is propelled along leg 20 with immersing to the exit end 12 where the excess water is drained from the fibers and the fibers allowed to drop into the lower depither.

Figure 3:
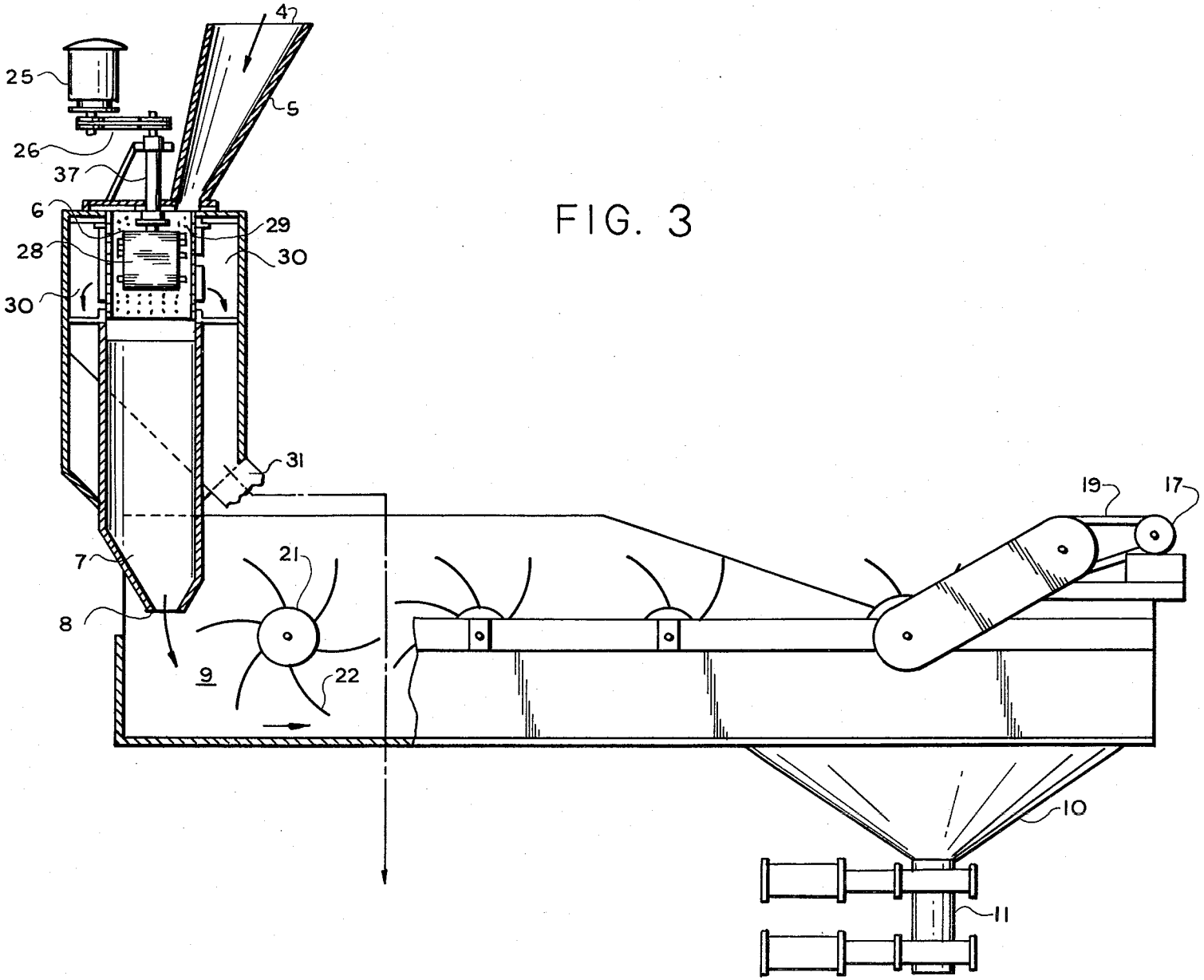
FIG. 3 is a sectional view of the fibrous material depithing and washing system along 3—3 of FIG. 2.
Figure 4:
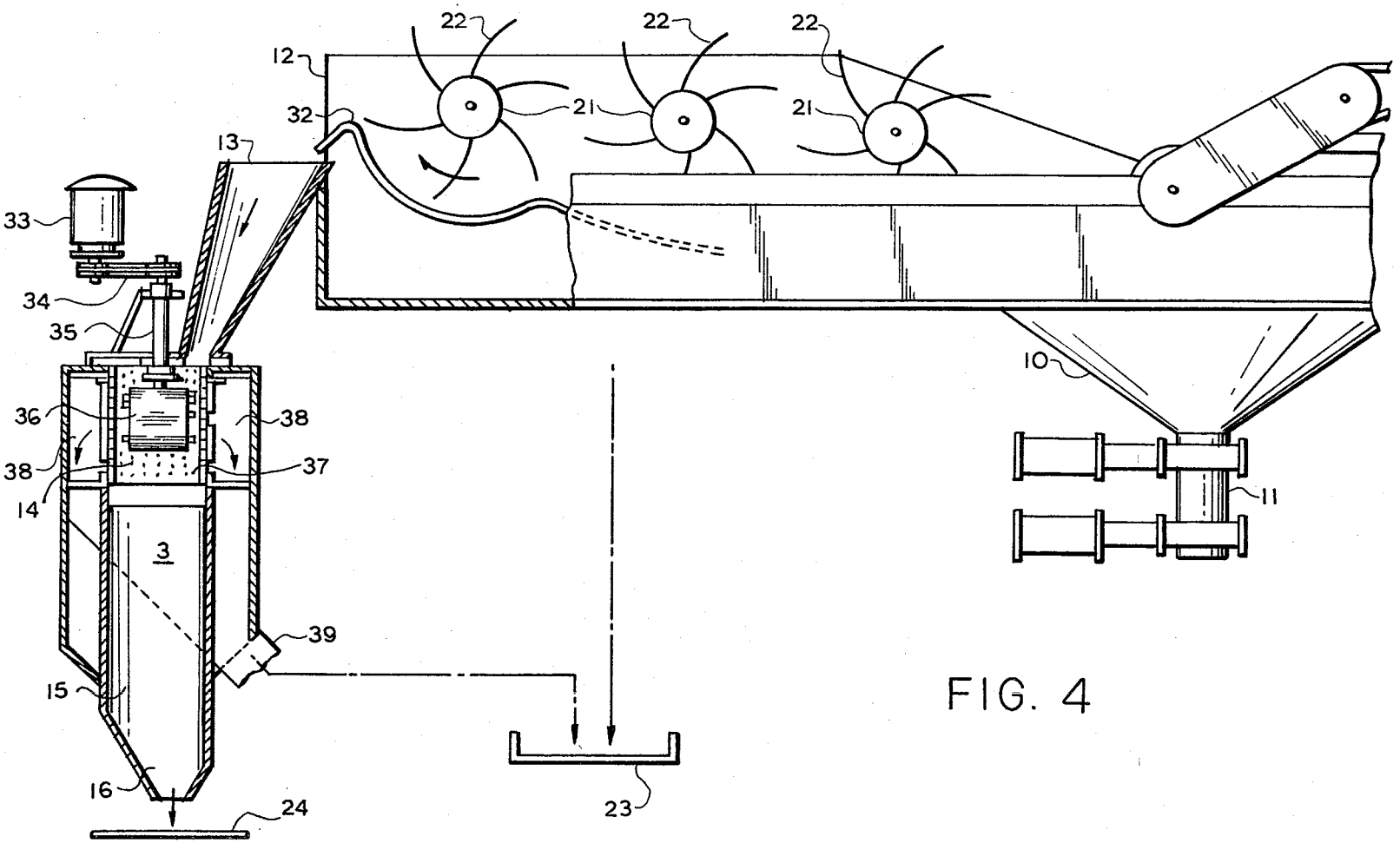
FIG. 4 is a sectional view of the fibrous material depithing and washing system along 4—4 of FIG. 2.

FIG. 3 shows in more detail the upper depither, the inlet leg of the washer and the loop of the U region. The upper depither consists of fiber fragment pin feeder 4(*a*), inlet 4 and inlet chute 5. The fiber fragments drop into depithing chamber 6 which consists of hammer assembly 28 which is surrounded by screen 29. In operation, the fiber fragments are operated on by the hammer assembly 28, which is driven by motor 25 through drive belts 26 and drive shaft 27. The pith which is removed from the fiber fragments passes through screen 29 and into surrounding chamber 30, whereupon it drops to pith exit chute 31. The fiber fraction is worked downwardly by the hammers of the hammer assembly and fall through fiber exit chute 7 to outlet 8 and thence into the washer inlet 9. FIG. 4 shows the remainder of the system in more detail. That is, it shows the outlet leg of the washer and the lower depither. The fiber is propelled down the outlet leg of the washer by tines 22 of rolls 21 and up onto drain screen 32. Excess water is drained from the fibers on this screen and the moist fibers are then allowed to drop into the inlet 13 of of depither unit 3. This depither 3 operates the same as depither 1. That is, fiber enters depither chamber 14 which consists of hammer assembly 36 surrounded by screen 37. The hammer assembly is driven by motor 33 via drive belts 34 and drive shaft 35. The pith which is separated from the fiber is driven through screen 37 into region 38 and to pith outlet 39. The pith falls onto conveyor 23 and is transported to storage or use as a fuel. The fiber fraction is worked downwardly through the depither chamber 14, to the fiber outlet chute 15, through fiber inlet 16 and onto conveyor 24. This fiber is conveyed to storage or as in most cases directly to a digester to make a pulp.

There are many advantages to the present system over the processes currently in use. These include less handling and manpower, decreased equipment needs, and more effective pith and debris removal. There is less handling and manpower required since the fiber is not collected from each operation (depithing and washing) and fed to the next operation. Also, overall safety is increased since workers do not have to be located near the high speed rotating depithers. As previously mentioned, fiber metering pin feeders are not needed for the washer and second (lower) depither. Likewise, since the fiber is entering the lower depither in a highly segregated manner, the lower depither draws less power than the upper depither, as well as less power than when a pin feeder would be used to meter the moist fiber into a depither. Also, since the fiber is maintained in a highly segregated state after exit from the first (upper) depither, there is more effective fiber washing and moist depithing. The fibers entering the washer are more effectively washed since they are highly segregated and are subsequently more effectively moist depithed.

I claim:

1. An improvement in the method of processing fibrous vegetable materials containing pith, said method consisting of the three separate operations of (i) metering fragments of said fibrous vegetable materials into a first depithing zone and at least partially depithing said fibrous material therein; (ii) collecting and metering the partially depithed fibers into a fiber washer and washing said partially depithed fiber therein; and (iii) collecting and metering the washed fiber into a second depithing zone and further depithing said washed fiber therein; the improvement comprising:

(a) arranging said first depithing zone vertically above said fiber washer and in turn arranging said fiber washer vertically above said second depithing zone;

(b) taking partially depithed fibers from the outlet of said first depithing zone and directing the gravitational fall of said partially depithed fibers from said first depithing zone downwardly directly into the inlet end of a fiber washer without metering said partially depithed fibers;

(c) removing the washed fibers from the outlet end of said washer at essentially the same rate that partially depithed fibers are entering said washer and directing said washed fibers downwardly by gravitational fall directly into the inlet of said second depithing zone without metering said washed fibers; and (d) collecting a substantially depithed fiber as it flows from said second depithing zone.

2. A method as in claim 1 wherein flow of fragments of crushed fibrous stalks into said first depithing zone is controlled at a definite rate.

3. A method as in claim 1 wherein said definite rate of flow of fragments of crushed fibrous stalks is controlled by means of a pin feeder.

4. A method as in claim 1 wherein said fibrous vegetable materials consist of bagasse.

5. An improvement in the system for processing fibrous vegetable materials containing pith, said system comprising:

(a) providing at least two vertical depither devices with pin feeder metering means to control the input of material into each device, a fiber washer with pin feeder metering means to control the input of material into the washer, first conveying means to feed fibrous vegetable material fragments into the inlet end of the first depither device, second conveying means to transport partially depithed fiber from the outlet end of said first depither device to the inlet end of said washer, and third conveying means to transport washed fiber from the outlet end of said washer to the inlet end of said second depither;

(b) said improvement comprising:

(i) disposing said first vertical depither device having a pin feeder metering device above the fiber inlet end of said washer whereby the partially depithed and metered fiber exiting the outlet end of said first depither device falls downwardly by gravity directly and in a separated condition into the inlet end of said washer without using a feed metering means;

(ii) disposing said second vertical depither device under the outlet end of said fiber washer whereby the washed fiber falls downwardly by gravity directly into said second vertical depithing device without using a feed metering means; and (iii) collecting a depithed fiber from the outlet end of said second vertical depither device.

* * * * *